US005860399A

United States Patent [19]

Speil et al.

[11] Patent Number: 5,860,399

[45] **Date of Patent: *Jan. 19, 1999**

[54] HYDRAULIC CLEARANCE COMPENSATION ELEMENT

[75] Inventors: Walter Speil, Ingolstadt; Dieter Schmidt, Nürnberg, both of Germany

[73] Assignee: Ina Walzlager Schaeffler KG, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 893,873

[22] Filed: Jul. 11, 1997

[30] Foreign Application Priority Data

Jul. 20, 1996 [DE] Germany ..... 196 29 313.8

[51] Int. Cl.[6] ..... F01L 1/24

[52] U.S. Cl. ..... 123/90.57; 123/90.55; 123/90.6; 74/567; 74/569

[58] Field of Search ..... 123/90.48, 90.49, 123/90.52, 90.55, 90.57, 90.6; 74/567, 569

[56] References Cited

U.S. PATENT DOCUMENTS

| | | | |
|---|---|---|---|
| 1,254,840 | 1/1918 | Nacker | 74/567 |
| 1,635,304 | 7/1927 | Baster | 74/567 |
| 4,524,731 | 6/1985 | Rhoads | 123/90.57 |
| 4,646,690 | 3/1987 | Hayashi | 123/90.57 |
| 4,741,298 | 5/1988 | Rhoads | 123/90.57 |
| 4,977,867 | 12/1990 | Rhoads | 123/90.57 |
| 5,241,927 | 9/1993 | Rhoads | 123/90.57 |
| 5,623,898 | 4/1997 | Bruton | 123/90.57 |

FOREIGN PATENT DOCUMENTS 4442376 5/1996 Germany .

OTHER PUBLICATIONS

Daniel Klaus, "Hydraulic Value Lash . . . Development", Motorzechnische Zeitschrift 41, pp. 539–542, Translation of Abstract only.

*Primary Examiner*—Weilun Lo
*Attorney, Agent, or Firm*—Bierman, Muserlian and Lucas

[57] ABSTRACT

A hydraulic clearance compensation element free of prior art disadvantages and manifesting substantially higher sink values over a wide range of temperatures.

5 Claims, 2 Drawing Sheets

HYDRAULIC CLEARANCE COMPENSATION ELEMENT

FIELD OF THE INVENTION

A hydraulic clearance compensation element comprising a hollow cylindrical housing (3) in whose bore (4) a pressure piston (5) is arranged relatively displaceable to the housing (3) while being supported at one end (14) on a bottom (8) of the housing (3) by a spring means (9), said pressure piston (5) comprising a non-return valve (10) which opens towards the bottom (8) of the housing (3), a high pressure chamber (11) for a servo means such as hydraulic medium being arranged between the end (14) and the bottom (8), which high pressure chamber (11) can be supplied through the non-return valve (10) with hydraulic medium from a reservoir (16) which is at least partly surrounded by the pressure piston (5), there being formed between the bore (4) and an outer peripheral surface (18) of the pressure piston (5) a leak gap (15), the clearance compensation element (1) being arranged in a housing whose bottom (7) is loaded in stroke direction by at least one cam (12) of a camshaft.

BACKGROUND OF THE INVENTION

Clearance compensation elements are sufficiently well-known in the art and are installed, for instance, in valve drives of internal combustion engines for compensating an undesired increase or decrease in clearance caused by thermal expansion or wear during the operation of the internal combustion engine. These elements operate with a servo means such as a hydraulic medium which is pressed through a leak gap between a housing and a pressure piston during a high pressure phase of the clearance compensation element.

One working in the field knows from the prior art that, especially during the time the engine is warming up from very low temperatures, a compensation, particularly of a decrease in clearance is not accomplished. This decrease in clearance results from the fact that when the engine is started in a cold state, a large heat input takes place, particularly at the exhaust valve and this causes a relative lengthening of the valve with respect to the surrounding components. After several rotations of the cam, hitherto known clearance compensation elements are not able to sufficiently compensate for this decrease in clearance with their leak gap and sink characteristics. This is the case when a gradient of relative sink lengths between the pressure piston and the housing, which cumulate at every successive lift cycle during a temperature variation in the valve drive, is flatter than a gradient of decrease in distance between a base circle of the cam and an end of a valve shaft associated to the clearance compensation element.

The valves, which as a consequence remain open, lead in the extreme case to a failure of combustion by reason of a poor cylinder filling and combustion. Under the most unfavorable conditions, the engine can "die". In addition, unburnt gases also lead to a premature failure of the catalytic converter. Under certain circumstances, once the engine has failed, it is not easy to start it for some time because the valves are still open and compression, as a result, is insufficient. These problems of decrease in clearance are enhanced, among other things, by a too high or pulsating oil pressure.

OBJECTS OF THE INVENTION

It is an object of the invention to provide a clearance compensation element in which the aforesaid drawbacks are eliminated and which particularly manifests substantially higher sink values through a wide temperature range than prior art clearance compensation elements.

This and other objects and advantages of the invention will become obvious from the following detailed description.

SUMMARY OF THE INVENTION

The novel hydraulic clearance compensation element (1) of the invention comprising a hollow cylindrical housing (3) in whose bore (4) a pressure piston (5) is arranged relatively displaceable to the housing (3) while being supported at one end (14) on a bottom (8) of the housing (3) by a spring means (9), said pressure piston (5) comprising a non-return valve (10) which opens towards the bottom (8) of the housing (3), a high pressure chamber (11) for a servo means such as hydraulic medium being arranged between the end (14) and the bottom (8), which high pressure chamber (11) can be supplied through the non-return valve (10) with hydraulic medium from a reservoir (16) which is at least partly surrounded by the pressure piston (5), there being formed between the bore (4) and an outer peripheral surface (18) of the pressure piston (5) a leak gap (15), the clearance compensation element (1) being arranged in a housing whose bottom (7) is loaded in stroke direction by at least one cam (12) of a camshaft, is characterized in that, at an end nearer an associated gas exchange valve (13), a width b and a flow resistance of the leak gap (15) of the clearance compensation element (1) are configured so that, under normal conditions, a ratio of a sink value AW (sec/mm) between the pressure piston (5) and the housing (3), to a mean leak gap diameter $d_m$ (mm) is approximately as:

$$0.03 \leqq \frac{AW}{d_m} \leqq 0.5(\text{sec/mm}^2),$$

said normal conditions being determined by a load of 1,500N from the pressure piston (5) to the housing (3), a kinematic viscosity of the servo means between 70±5 $mm^2/s$ and a temperature of 20° C.

These measures guarantee that particularly negative length variations in the valve drive can be compensated by the clearance compensation element sufficiently rapidly over a wide temperature range. The person skilled in the art is enabled to set optimum conditions at the leak gap by varying the proposed parameters. To avoid a too wide scatter of the sink values, at least for the particular engine in question, it is likewise proposed that a quotient out of the numerically largest and smallest sink values should not be substantially higher than 6. Advantageously, this quotient could be made to apply not only to the clearance compensation elements of the engine in question but to all clearance compensation elements intended for a particular type of engine.

The lowest sink value $AW_{min} \cdot d_m^{-1}=0.03$ (sec/$mm^2$) therefore characterizes the largest loss of lift during a lift cycle, and a further reduction of this sink value is limited by a maximum height of the closing ramp of the cam because the ramp height would have to be raised by an amount corresponding to this reduction. A result of a too rapid sinking can therefore be that the gas exchange valve reaches its seat too early and too rapidly which would not only lead to premature wear and noise generation but also to poor gas exchange. The upper sink value $AW_{max} \cdot d_m^{-1}=0.5$ (sec/$mm^2$) characterizes the slowest possible sinking of the clearance compensation element required to just about enable a complete closing of the gas exchange valve through all temperature ranges when the valve undergoes a positive length variation. If this maximum value is exceeded due to unfavorable conditions at the leak gap, the aforesaid problems are encountered during the operation of the internal combustion engine.

All dimension ratios given herein apply basically to a direct actuation of a gas exchange valve by an overhead cup tappet or the like. In the case of an indirect actuation through a rocker arm or finger lever, the appropriate transmission ratio has to be incorporated into the equations.

The above-mentioned conditions can be implemented by making the leak gap in the clearance compensation element distinctly wider than the leak gaps in prior art clearance compensation elements of the same dimensions for the same types of engines. Another means of obtaining the same results is to shorten the length of the leak gap or to provide additional leak points such as bores or the like in the high pressure chamber.

According to a further embodiment of the invention, a larger loss of lift resulting from the more rapid sink values of the invention is compensated by an appropriate configuration of the closing ramp of the cam. According to the invention, the closing ramp in advance of the base circle in the direction of rotation should not exceed a maximum permissible height and should guarantee, at the same time, that the speed at which the gas exchange valve comes to be seated on its seat is as low as possible.

According to still another embodiment of the invention, a region of the closing ramp nearer the base circle is not unnecessarily lengthened because this would have an unfavorable effect on valve overlap. Thus, only a region of the closing ramp in which the gas exchange valve closes most frequently is configured so that the closing speed imparted by it to the gas exchange valve is constant. The end regions of the closing ramp on either side of this region are configured so as to impart a decreasing speed to the gas exchange valve in the direction of rotation. If, notwithstanding, at extreme temperatures, a seating of the gas exchange valve occurs in its upper dead center position during one of the phases of decreasing speed, this is acceptable because only a slight wear would be caused by reason of the, statistically seen, small number of seatings.

Figure 1:
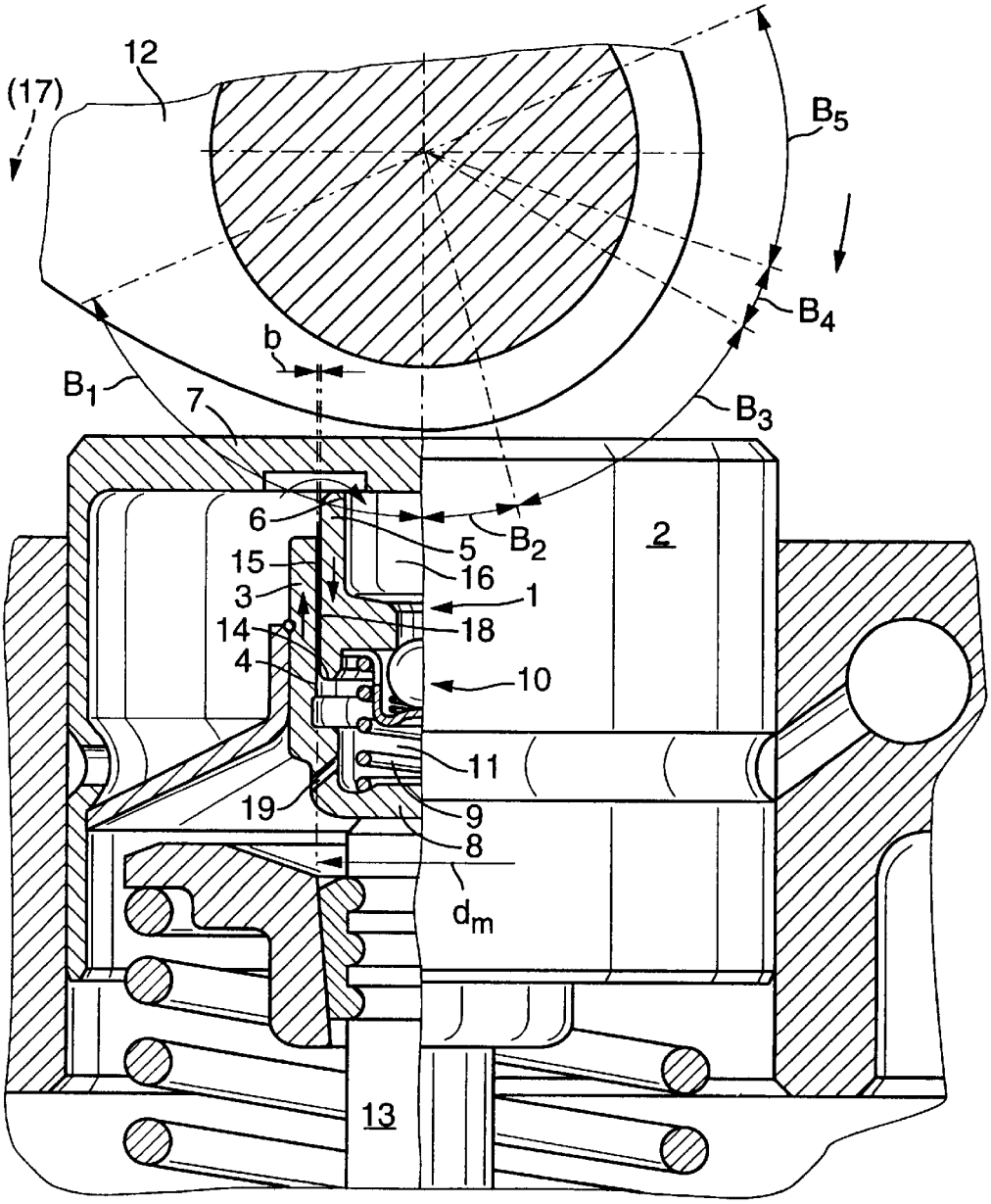
FIG. 1 is a cross-section of a hydraulic clearance compensation element in a cup tappet.

The FIG. 1 shows a hydraulic clearance compensation element 1 installed in a known manner in a cup tappet 2 which clearance compensation element 1 comprises a hollow cylindrical housing 3 in whose bore 4 a pressure piston 5 is arranged for relative displacement. One end 6 of the pressure piston 5 is supported on a bottom 7 of the cup tappet 2, while an opposite end of the pressure piston 5 is supported by a spring means 9 on a bottom 8 of the housing 3. The pressure piston 5 comprises a non-return valve 10 which requires no further specification here, said non-return valve 10 opening towards the bottom 8. A high pressure chamber 11 for hydraulic medium extends in axial direction between the pressure piston 5 and the bottom 8. The cup tappet 2 is loaded in stroke direction on its bottom 7 by a cam 12. A lift of the cam 12 is thus transmitted from the cam 12, through the cup tappet 2, to a gas exchange valve 13, for example, an exhaust valve, facing the bottom 8 of the housing 3.

Figure 2:
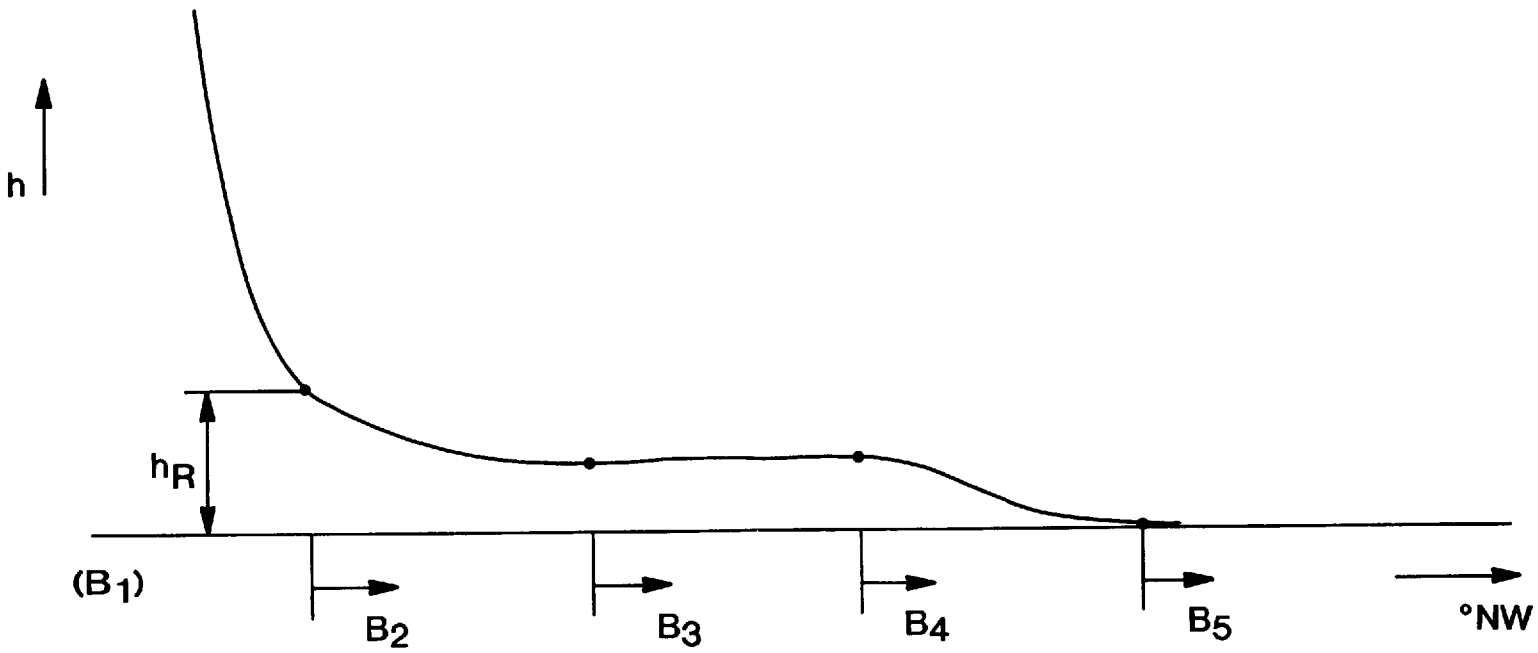

FIG. 2 is a graph of the cam lift (h) over the cam rotation °NW where $h_R$ is the height of the closing ramp in the range $B_2$ to $B_4$ . This shows the general lift of the cam which it imparts to this exchange valve and the rotation of the cam.

A basic description of the method of functioning of the clearance compensation element 1 installed in the cup tappet 2 is not given here because it is sufficiently well-known in the art. However, it must be mentioned that during every lift motion of the cam 12, a certain amount of hydraulic medium is pressed out through a leak gap 15 between the housing 3 and the pressure piston 5. During a base circle phase $B_5$ of the cam 12, an elimination of the play occurring in the valve drive is effected by a defined amount of hydraulic medium being re-sucked into the high pressure chamber 11 from a reservoir 16 which is enclosed in the pressure piston 5. At the same time, the spring means 9 assures that the force engagement between the cup tappet 2, the cam 12 and the gas exchange valve 13 remains free of play. The aforesaid variation in length of the clearance compensation element 1 caused by the pressing-out of hydraulic medium from the high pressure chamber 11 is not only required for the compensation of valve clearance but also for compensating dilatations in the valve drive which can be caused, for example, by wear on the valve seat or by thermal expansion as described above.

The invention therefore proposes, for instance, that a width b of the leak gap 15 be larger, and/or a length of the leak gap 15 be smaller than in comparable clearance compensation elements. It is possible to determine these dimensions experimentally under normal conditions by adjusting a ratio of a sink value AW (sec/mm) of the pressure piston 5 relative to the housing 3, to a mean leak gap diameter $d_m$ (mm) to lie between 0.03 and 0.5 (sec/mm$^2$). The mean leak gap diameter ($d_m$) and how it is measure determined as follows. Proceeding from an ideal bore of the housing (3) and an ideal outer diameter of the pressure piston (5), these two values are added together and then divided by two to obtain the mean leak gap diameter ($d_m$). In practice, one skilled in the art would take several measurements over the heights of the leak gap which may be distributed over the periphery. Taking an example of six measurements, one would obtain 12 values (6 pairs) which would then have to be added together and divided by 12. The larger the number of measurements, the more accurately can the mean leak gap diameter ($d_m$) be determined. To assure a small scatter of values between clearance compensation elements 1 of a particular type of engine with the same dimensions, it is particularly advantageous if a ratio of a maximum sink value $AW_{max}$ to a minimum sink value $AW_{min}$ is given by $AW_{max}/AW_{min} \leqq 6$. This assures a sufficient sinking of the pressure piston 5 relative to the housing 3 through all temperature ranges (see introductory description), particularly when a rapid lengthening of the gas exchange valve 13 occurs in the direction of the cam 12 due to high heat input. Respecting these parameters is a simple means for an engine specialist to assure a closing of the gas exchange valve 13 under all operational conditions. At the same time, the lower value 0.03 (sec/mm$^2$) defines a limit which, when respected, prevents the gas exchange valve 13 from reaching its seat prematurely by reason of the small leak gap resistance, with the known disadvantages.

The regions $B_2$ to $B_4$ identify a closing ramp of the cam 12, the region $B_1$ identifies a run-off flank following the cam tip 17, and the region $B_5$ identifies the base circle of the cam 12. To compensate for the largest losses of lift in the clearance compensation element 1 which are dependent upon the sink time, a height $h_R$ of the closing ramp $B_2$ to $B_4$ should be $\leqq$0.35 mm and the closing speed v of the gas exchange valve 13 in the region $B_2$ to $B_4$ should, at the same time, not exceed 40 $\mu$m per degree of cam angle (°NW).

The region $B_3$ can be considered and configured as the region in which, statistically seen, the most frequent seatings of the gas exchange valve 13 occur. It is therefore proposed to give a linear configuration to the speed curve of the region $B_3$ so that the speed transmitted to the gas exchange valve 13 is constant which assures a "soft" seating of the gas exchange valve 13 on its seat. To shorten the remaining regions $B_2$ and $B_4$ of the closing ramp, it is further proposed to configure their speed curves so that they impart a speed which decreases in the direction of rotation. It is understood that it is likewise possible to configure the speed curve of the entire closing ramp $B_2$ to $B_4$ so that the imparted speed decreases continuously.

In a preferred embodiment of the clearance compensation element of the invention, a height hR of a closing ramp $B_2$ to $B_4$ arranged immediately in advance of a base circle $B_5$ of the cam (12) is approximately ≦0.35 mm and transmits a closing speed v of approximately 40 to 0 μm/°NW to the associated gas exchange valve (13), and a mean closing speed $V_D$ of the gas exchange valve (13) over a length of the closing ramp $B_2$ to $B_4$ is approximately $$15\mu m/°NW \leqq V_D < 40\mu m°NW$$

or a region $B_3$ of a closing ramp $B_2$ to $B_4$ in which, statistically seen, the gas exchange valve (13) closes most frequently is configured with an approximately constant closing speed, while regions $B_2$ and $B_4$ of the closing ramp situated on each side of the region $B_3$ are configured with speeds which decrease in a direction of rotation.

Various modifications of the hydraulic clearance compensation element of the invention may be made without departing from the spirit or scope thereof and it is to be understood that the invention is intended to be limited only as defined in the appended claims.

What we claim is:

1. A valve drive comprising a hydraulic clearance compensation element (1) loaded by a cam of a camshaft, the compensation element comprising a hollow cylindrical housing (3) in whose bore (4) a pressure piston (5) is arranged relatively displaceable to the housing (3) while being supported at one end (14) on a bottom (8) of the housing (3) by a spring means (9), said pressure piston (5) comprising a non-return valve (10) which opens towards the bottom (8) of the housing (3), a high pressure chamber (11) for a servo means of hydraulic medium being arranged between the end (14) and the bottom (8), which high pressure chamber (11) can be supplied through the non-return valve (10) with hydraulic medium from a reservoir (16) which is at least partly surrounded by the pressure piston (5), there being formed between the bore (4) and an outer peripheral surface (18) of the pressure piston (5) a leak gap (15), the clearance compensation element (1) being arranged in a housing whose bottom (7) is loaded in a stroke direction by said cam (12), characterized in that a height ($h_R$) of a closing ramp ($B_2$ to $B_4$) of the cam arranged immediately in advance of a base circle ($B_5$) of the cam (12) is approximately less than or equal to 0.35 mm and transmits a closing speed (v) of approximately 40 to 0 micrometer per degree of cam angle (μm/°NW) to the associated gas exchange valve (13), and a mean closing speed ($v_D$) of the gas exchange valve (13) over a length of the closing ramp ($B_2$ to $B_4$) is approximately $$15\mu m/°NW \leqq v_D \leqq 40\mu m/°NW,$$

a region ($B_3$) of said closing ramp ($B_2$ to $B_4$) in which, statistically seen, the gas exchange valve (13) closes most frequently is configured with an approximately constant closing speed, while regions ($B_2$ and $B_4$) of the closing ramp situated on each side of the region ($B_3$) are configured with speeds which decrease in a direction of rotation of the cam, a width (b) and a flow resistance of the leak gap (15) of the clearance compensation element (1) are configured so that, under normal conditions, a ratio of a sink value (AW in sec/mm) between the pressure piston (5) and the housing (3), to a mean leak gap diameter ($d_m$ in mm) is approximately as:

$$0.03 \leqq \frac{AW}{d_m} \leqq 0.5(sec/mm^2),$$

said normal conditions being determined by a load of 1,500N from the pressure piston (5) to the housing (3), a kinematic viscosity of the servo means between 70±5 $mm^2/s$ and a temperature of 20° C.

2. A clearance compensation element of claim 1 wherein a quotient out of extreme values ($AW_{max}$, $AW_{min}$) of a scatter of sink values of all clearance compensation elements (1) of equal dimensions for at least one particular internal combustion engine is approximately $$\frac{AW_{max}}{AW_{min}} \leqq 6.$$

3. A clearance compensation element of claim 1 wherein an additional oil passage (19) leads out of the high pressure chamber (11).

4. A valve drive comprising hydraulic clearance compensation element (1) loaded by a cam of a camshaft, the compensation element comprising a hollow cylindrical housing (3) in whose bore (4) a pressure piston (5) is arranged relatively displaceable to the housing (3) while being supported at one end (14) on a bottom (8) of the housing (3) by a spring means (9), said pressure piston (5) comprising a non-return valve (10) which opens towards the bottom (8) of the housing (3), a high pressure chamber (11) for a servo means of hydraulic medium being arranged between the end (14) and the bottom (8), which high pressure chamber (11) can be supplied through the non-return valve (10) with hydraulic medium from a reservoir (16) which is at least partly surrounded by the pressure piston (5), there being formed between the bore (4) and an outer peripheral surface (18) of the pressure piston (5) a leak gap (15), the clearance compensation element (1) being arranged in a housing whose bottom (7) is loaded in stroke direction by said cam (12), characterized in that a height ($h_R$) of a closing ramp ($B_2$ to $B_4$) of the cam arranged immediately in advance of a base circle ($B_5$) of the cam (12) is approximately less than or equal to 0.35 mm and transmits a closing speed (v) of approximately 40 to 0 micrometer per degree of cam angle (μm/°NW) to the associated gas exchange valve (13), and a mean closing speed ($v_D$) of the gas exchange valve (13) over a length of the closing ramp ($B_2$ to $B_4$) is approximately $$15\mu m/°NW \leqq v_D \leqq 40\ \mu m/°NW,$$

a region ($B_3$) of said closing ramp ($B_2$ to $B_4$) in which, statistically seen, the gas exchange valve (13) closes most frequently is configured with an approximately constant closing speed, while regions ($B_2$ and $B_4$) of the closing ramp situated on each side of the region ($B_3$) are configured with speeds which decrease in a direction of rotation of the cam.

5. A clearance compensation element of claim 4 wherein an additional oil passage (19) leads out of the high pressure chamber (11).

* * * * *